US005279275A

United States Patent [19]

Freudenberg

[11] Patent Number: 5,279,275

[45] Date of Patent: Jan. 18, 1994

[54] PROCESS FOR OPERATING AN INTERNAL COMBUSTION ENGINE

[75] Inventor: Hellmut Freudenberg, Pentling, Fed. Rep. of Germany

[73] Assignee: Siemens Aktiengesellschaft, Munich, Fed. Rep. of Germany

[21] Appl. No.: 820,647

[22] PCT Filed: Sep. 26, 1990

[86] PCT No.: PCT/EP90/01628

§ 371 Date: Jan. 16, 1992

§ 102(e) Date: Jan. 16, 1992

[87] PCT Pub. No.: WO91/05153

PCT Pub. Date: Apr. 18, 1991

[30] Foreign Application Priority Data

Oct. 5, 1989 [EP] European Pat. Off. ..... 89118488.9

[51] Int. Cl.[5] ..... F02D 41/14; F02D 41/06; F02D 41/10

[52] U.S. Cl. ..... 123/682; 123/686

[58] Field of Search ..... 123/491, 681, 682, 683, 123/684, 685, 686

[56] References Cited

U.S. PATENT DOCUMENTS

| | | | |
|---|---|---|---|
| 4,096,834 | 6/1978 | Norimatsu et al. | 123/682 |
| 4,119,072 | 10/1978 | Asano | 60/276 |
| 4,143,623 | 3/1979 | Norimatsu et al. | 123/682 |
| 4,753,209 | 6/1988 | Hibino et al. | 123/491 |

FOREIGN PATENT DOCUMENTS

| | | |
|---|---|---|
| 58-104336 | 6/1983 | Japan . |
| 60-69242 | 4/1985 | Japan . |
| 60-206953 | 10/1985 | Japan . |
| 1510405 | 5/1978 | United Kingdom . |

*Primary Examiner*—Tony M. Argenbright
*Attorney, Agent, or Firm*—Hill, Steadman & Simpson

[57] ABSTRACT

In special operating mode, such as, for example, warming up, acceleration, full load, the setting of the mixture is, as is known, performed by a control instead of a λ adjustment. This can result in a lean mixture. This is avoided by the fact that the λ adjustment remains switched on with a restricted range of adjustment during the special operating mode. It is superimposed on the pilot control and only acts in the direction of enrichment.

5 Claims, 1 Drawing Sheet

PROCESS FOR OPERATING AN INTERNAL COMBUSTION ENGINE

BACKGROUND OF THE INVENTION

The invention relates to a process for operating an internal combustion engine.

A customary λ adjustment adjusts the mixture of fuel and air to be fed to an internal combustion engine to a stoichiometric ratio. During special operating conditions which require a rich mixture, the λ adjustment must therefore be switched off and its task is assumed by a control.

This process works satisfactorily as long as the control sets the required rich mixture correctly during the special operation. However, maladjustment or corresponding long-term changes may lead to the setting of a lean mixture instead of the required rich mixture. Particularly towards the end of a special operation, when the rich mixture is brought back to a stoichiometric mixture ratio in order to achieve a continuous transition to the subsequent λ adjustment, even small maladjustments of the control in the lean direction lead to an undesirably lean mixture. Since, during control, there is no feedback, this error also remains undetected and manifests itself only in a poorer operating behavior of the engine.

U.S. Pat. No. 4,753,209 discloses a mixture adjustment system for an internal combustion engine with a λ adjustment, the λ probe supplying a linear output signal. Prior to the readiness of the λ probe for operation, temperature-dependent control of a choke valve is carried out. During the warm-up phase of the engine and after the operating temperature of the λ probe has been achieved, coarse λ adjustment takes place via the choke valve and fine λ adjustment via a bypass valve. The use of a λ probe with a linear characteristic ensures that a fuel/air mixture in a range from lean to rich can be set even in the warm-up phase of the internal combustion engine.

SUMMARY OF THE INVENTION

The object of the invention is, in contrast, to improve mixture control during such special operating conditions of the engine.

The solution according to the invention is a process for operating an internal combustion engine with a λ probe and a λ adjuster which adjust the mixture of fuel and air to be fed to the internal combustion engine to a setpoint value as a function of the output signal of the λ probe in the adjusting mode and with a control. During special operating conditions, the fuel/air mixture is set to a mixture value which lies on the rich side, below the setpoint value which the λ adjuster sets outside the special operating conditions. During the special operating conditions, the λ adjuster acts asymmetrically, adjusting the mixture only in the rich direction. In further advantageous developments of the invention the special operating condition can be the warming-up of the internal combustion engine. After the starting of the internal combustion engine and when a special operating temperature is reached, the λ adjuster is switched on with the restricted range of adjustment, and the range of adjustment is enabled without restriction only when a minimum cooling-water temperature is reached. Alternatively, the special operating condition can be the acceleration mode of the internal combustion engine or the full-load mode of the internal combustion engine.

The solution according to the invention consists in switching on the λ adjustment during the control mode as well, but with a restricted range of adjustment. With an unrestricted range of adjustment, the λ adjustment would adjust the rich mixture set by the control back in the lean direction, to a stoichiometric ratio with an air ratio of $\lambda=1$. The range of adjustment of the λ adjuster is therefore restricted such that it only adjusts in the rich direction and not in the lean direction. The λ adjustment thus does not intervene when the mixture is rich. If, however, the control erroneously sets a lean mixture, the λ adjustment can intervene in the enriching direction and thus mitigate the error to a tolerable degree.

The warming up of the internal combustion engine is one of the special operating conditions which require a rich mixture. According to a further development of the invention, the λ adjuster is therefore switched on with the restricted range of adjustment as soon as a probe operating temperature of the λ probe is reached after the starting of the internal combustion engine, i.e. as soon as the λ adjustment itself is ready for operation. Only when a minimum cooling-water temperature is reached, indicating the end of warming up, at which the engine no longer needs a rich mixture, is the range of adjustment then enabled to an unrestricted degree in the rich and lean direction.

Further special operating conditions which require a rich mixture are the acceleration mode and the full-load mode. In these modes, the probe operating temperature of the λ probe has already been reached and the λ adjustment with a restricted range of adjustment can therefore be switched on during the entire acceleration or full-load mode.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
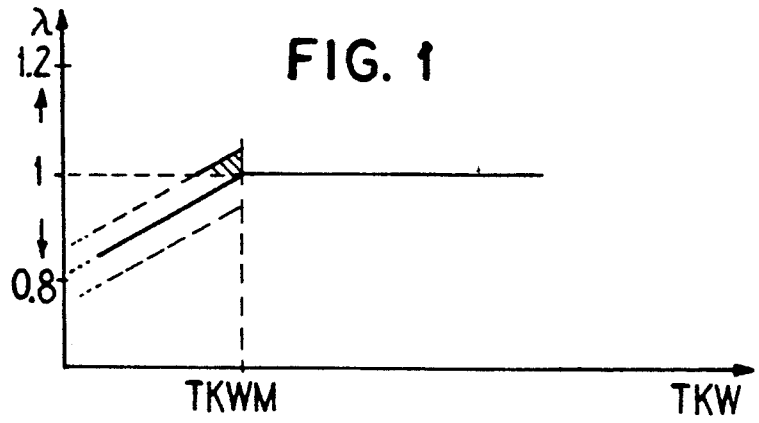
FIG. 1 shows a diagram to illustrate the process according to the invention, using warming up as an example.

In the diagram of FIG. 1, the air ratio λ is plotted against the cooling-water temperature TKW. In the case of an air ratio of $\lambda=1$, the ratio of fuel and air is stoichiometric, indicating optimum combustion. Air ratio values for λ of less than 1 indicate a mixture with elevated fuel values relative to the stoichiometric ratio and, accordingly, air ratio values greater than 1 indicate a lean mixture with elevated air values.

Up until a minimum cooling-water temperature TKWM is reached, the engine is in the warm-up phase. During this phase, a rich mixture is set as a function of the level of the cooling-water temperature TKW upon starting. Up until the minimum cooling-water temperature TKWM is reached, this initially set mixture is controlled to the stoichiometric mixture ratio in accordance with the increase in the engine temperature. Such an ideal mixture variation is illustrated in FIG. 1 by the solid line. When the minimum cooling-water temperature TKWM is reached, the λ adjustment then sets a stoichiometric mixture ratio, this being depicted in FIG. 1, again in idealized form.

Running parallel to the ideal mixture variation during the warm-up phase are two dashed lines which illustrate the fluctuation range of the mixture values set by a real control. A mixture variation according to the lower line thus signifies an enrichment which goes beyond the degree required and the upper line signifies inadequate enrichment. In the case of the mixture variation according to the upper line, the mixture values towards the end of the warm-up phase may even be above the stoichiometric ratio in the lean direction. However, it is precisely during the warm-up phase that this is undesired since satisfactorily smooth running of the engine is then no longer guaranteed.

The process according to the invention reliably prevents such a lean mixture during the warm-up phase. By virtue of the fact that, in addition to the control, the λ adjustment is also switched on, only for adjustment in the rich direction, all the mixture values set by the control which are above the stoichiometric ratio are adjusted back to the stoichiometric ratio. Mixture values which are in the range of the hatched triangle in FIG. 1 are thus not possible. As long as the control sets mixture values in the rich direction which are below the stoichiometric ratio, the λ adjustment cannot intervene, since adjustment in the lean direction is blocked.

Figure 2:
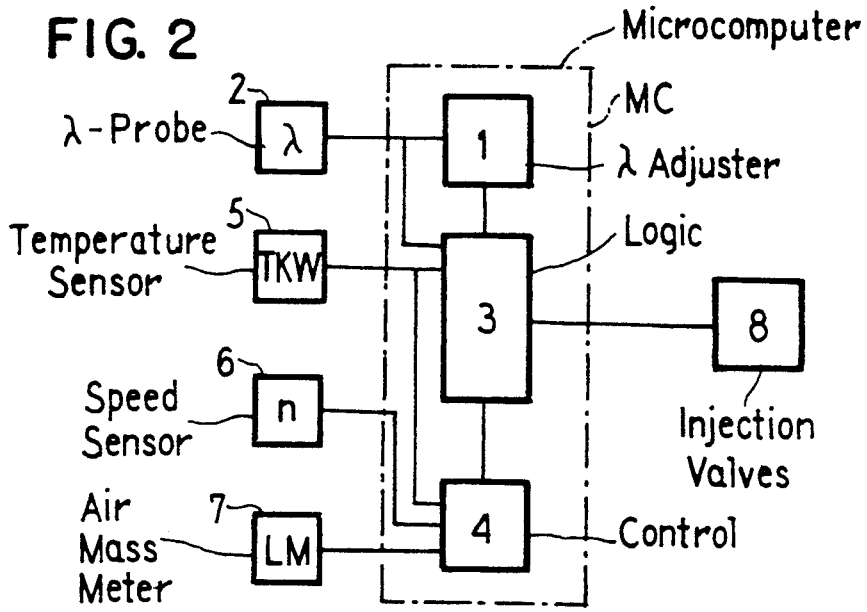
FIG. 2 shows a simplified block diagram of an arrangement for carrying out the process and FIG. 3 shows a flow chart for carrying out the process.

An arrangement for operating an internal combustion engine for the purpose of carrying out the process according to the invention is shown in FIG. 2. In this figure, 1 denotes a λ adjuster, 3 denotes a logic device and 4 denotes a control. The functions of these three devices are performed by a correspondingly programmed microcomputer MC.

The microcomputer MC receives at corresponding inputs the signals for an air ratio λ from a λ probe 2, a cooling-water temperature TKW from a temperature sensor 5, a speed n from a speed sensor 6 and an air mass LM from an air mass meter 7. An output of the microcomputer MC is connected to injection valves 8 with appropriate controls. The quantity of fuel injected and hence the mixture ratio is determined via the opening time, controlled by these means, of the individual injection valves.

For the control mode, the control 4 receives as input variables the cooling-water temperature TKW, the speed n and the air mass LM. Via the speed n and the air mass LM, that is to say the load on the engine, the control 4 determines the quantity of fuel to be injected from a characteristic map. A further characteristic map contains an additional quantity of fuel required for the case of cold starting, as a function of the cooling-water temperature TKW. This enrichment effected in the case of cold starting is then reduced again up to the end of the warm-up phase in accordance with the function shown in FIG. 1.

For the λ adjustment, the λ adjuster 1 receives as input variable the air ratio λ and, from this, determines fuel injection values which correspond to a stoichiometric mixture ratio.

The output signals of the control 4 and of the λ adjuster 1 are fed to a logic device 3. This chooses from the two output signals the one which is passed to the injection valve 8.

Figure 3:
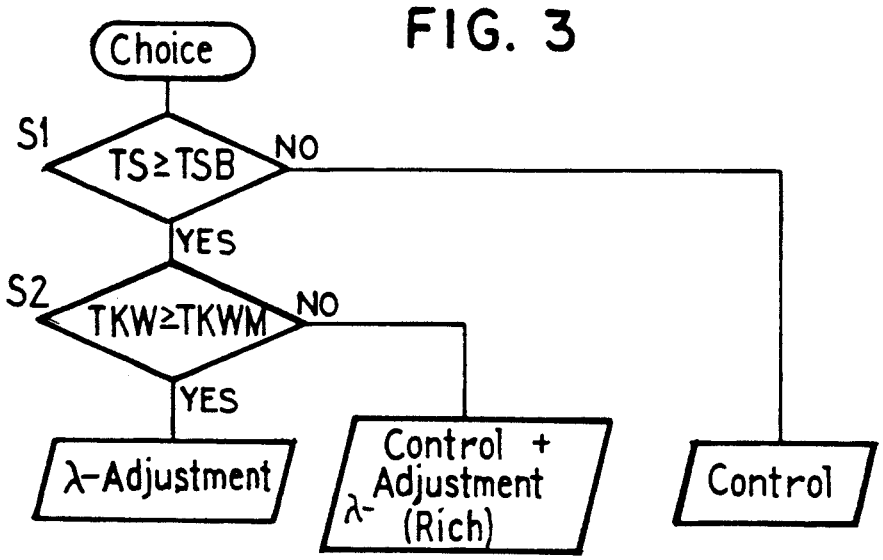

In order to make this choice, the logic device 3 is supplied with the air ratio λ and the cooling-water temperature TKW. The choice is explained by means of the flow chart of FIG. 3.

In step S1, the logic device 3 checks whether the probe temperature TS of the λ probe 2 is greater than or equal to the probe operating temperature TSB. This probe temperature TS is calculated via the voltage level of the output signal of the λ probe 2, which represents the air ratio. The probe temperature TS could of course also be obtained from the output signal of a temperature sensor associated with the λ probe 2.

If the answer in step S1 is no, the λ probe 2 is not yet ready for operation and the logic device 3 calls a program block "control", which represents the function of the control 4.

If, on the other hand, the answer in step S1 is yes, the λ probe 2 thus being ready for operation, step S2 follows. In this, a check is made as to whether the cooling-water temperature TKW is greater than or equal to the minimum cooling-water temperature TKWM.

If this is not the case, that is to say the answer is no, the engine is in its warm-up phase. The logic device 3 accordingly calls a program block "control and λ adjustment (rich)". This program block contains the functions of the control 4 and of the λ adjuster 1, the function of the λ adjuster 1 being performed only in the enriching direction. The λ adjustment thus only comes into effect if the control would produce mixture values which are above the stoichiometric ratio in the lean direction. In this case, the function corresponding to the λ adjuster 1 comes into effect, with the result that the mixture values set do not exceed the stoichiometric ratio.

On completion of the warm-up phase, the answer in step S2 is yes since the minimum cooling-water temperature TKWM has been reached. A program block "λ adjustment" then follows, performing the customary function of λ adjustment.

The invention is not limited to the particular details of the method depicted and other modifications and applications are contemplated. Certain other changes may be made in the above described method without departing from the true spirit and scope of the invention herein involved. It is intended, therefore, that the subject matter in the above depiction shall be interpreted as illustrative and not in a limiting sense.

What is claimed is:

1. A process for operating an internal combustion engine, with a λ probe and a λ adjuster which adjusts a mixture of fuel and air to be fed to the internal combustion engine to a setpoint value as a function of an output signal of the λ probe in an adjusting mode and with a control which, during at least one special operating condition, sets the mixture of fuel and air to a mixture value which lies on a rich side, below the setpoint value which the λ adjuster sets outside the at least one special operating condition, wherein, during the at least one special operating condition, the λ adjuster acts asymmetrically, adjusting the mixture only in a rich direction.

2. The process as claimed in claim 1, wherein the at least one special operating condition is a warming up of the internal combustion engine, after the starting of the internal combustion engine and when a probe operating temperature is reached, the λ adjuster is switched on with a restricted range of adjustment, and the range of adjustment is enabled without restriction only when a minimum cooling-water temperature is reached.

3. The process as claimed in claim 1, wherein the at least one special operating condition is an acceleration mode of the internal combustion engine.

4. The process as claimed in claim 1, wherein the at least one special operating condition is a full-load mode of the internal combustion engine.

5. A process for operating an internal combustion engine, with a λ probe and a λ adjuster which adjusts a mixture of fuel and air to be fed to the internal combustion engine to a setpoint value as a function of an output signal of the λ probe in an adjusting mode and with a control which, during a special operating condition that is a warming up of the internal combustion engine, sets the mixture of fuel and air to a mixture value which lies on a rich side, below the setpoint value which the λ adjuster sets outside the special operating condition, and during the special operating condition, the λ adjuster acting asymmetrically, adjusting the mixture only in a rich direction, and after the starting of the internal combustion engine and when a probe operating temperature is reached, the λ adjuster being switched on with a restricted range of adjustment, and the range of adjustment being enabled without restriction only when a minimum cooling-water temperature is reached.

* * * * *